US006512214B2

(12) United States Patent
Jeong et al.

(10) Patent No.: US 6,512,214 B2
(45) Date of Patent: Jan. 28, 2003

(54) APPARATUS FOR SUSPENDING MICROWAVE OVEN

(75) Inventors: Sang-jin Jeong, Suwon (KR); Kwang-il Yang, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 52 days.

(21) Appl. No.: 09/789,818

(22) Filed: Feb. 22, 2001

(65) Prior Publication Data

US 2002/0050549 A1 May 2, 2002

(30) Foreign Application Priority Data

Oct. 26, 2000 (KR) ..... 00/63223

(51) Int. Cl.[7] ..... H05B 6/80

(52) U.S. Cl. ..... 219/756; 126/273 A; 248/317; 248/339

(58) Field of Search ..... 219/756, 757; 312/236; 248/339, 317, 304, 305, 301; 126/273 A, 275 E, 332, 337 R

(56) References Cited

U.S. PATENT DOCUMENTS 4,580,853 A * 4/1986 Hitzeroth et al. ..... 312/245
4,651,963 A * 3/1987 Busse et al. ..... 248/323
4,666,113 A * 5/1987 Itoh et al. ..... 248/201
4,753,406 A * 6/1988 Kodama et al. ..... 248/327

* cited by examiner

*Primary Examiner*—Philip H. Leung
(74) *Attorney, Agent, or Firm*—Robert E. Bushnell, Esq.

(57) ABSTRACT

An apparatus for suspending a microwave oven, which includes a main body having a rear plate formed with a through hole thereon and a cooking chamber formed therein, comprises: a support plate mounted to a wall face to which the microwave oven is installed; a hooking member protruding toward the main body through the through hole of the rear plate from a planar surface of the support plate; a plate spring having one end portion fixed to the main body and the other end portion elastically deformable between a first position where the plate spring is disengaged from the hooking member and a second position where the plate spring is engaged with the hooking member; and an actuating member connected between the microwave oven and the plate spring for elastically deforming the plate spring between the first position and the second position. With this configuration, there is provided an apparatus for installing a microwave oven in suspension structure, allowing the microwave oven to be provisionally installed to the support plate with a simplified structure and a high coupling force.

24 Claims, 6 Drawing Sheets

APPARATUS FOR SUSPENDING MICROWAVE OVEN

CLAIM OF PRIORITY

This application makes reference to, incorporates the same herein, and claims all benefits accruing under 35 U.S.C. §119 from an application for APPARATUS FOR SUSPENDING MICROWAVE-OVEN earlier filed in the Korean Industrial Property Office on Oct. 2, 2000 and there duly assigned Ser. No. 63223/2000.

BACKGROUND OF THE INVENTION

1. Field of the Invention

The present invention relates in general to microwave ovens and, more particularly, to an apparatus for suspending a microwave oven.

2. Description of the Related Art

A microwave oven is a cooking apparatus for making food by means of electromagnetic waves generated from a magnetron therein. Generally, the microwave oven is placed on a lower sink table or in a space provided within a cabinet in the kitchen. Considering a user's convenience, space for installation or interior design, the microwave oven is sometimes installed over a sink table on the bottom face of an upper cabinet, and is referred to as "a wall-mounted type microwave oven."

Referring to FIG. 5, which is an enlarged perspective view showing a main portion of a conventional wall-mounted microwave oven, the microwave oven is provisionally installed to a support plate 116 of a planar shape fixed to a wall face before it is suspended on the bottom plate of the upper cabinet. The provisional installation of the microwave oven is required because it is not easy to directly suspend the relatively heavy microwave oven over the sink table while lifting up the microwave oven. To facilitate the suspension, the microwave oven is provisionally installed by means of the support plate 116.

A pair of projections (not shown) are provided in the lower part of the support plate 116. Hooking members 118 are disposed over the projections in parallel with each other and between a main body 121 and an outer casing (not shown), as shown in FIGS. 5 and 6. The hooking members 118 pass through through holes 135 formed in the main body 121. Each of the hooking members 118 comprises an extension 119 protruding from the planar surface of the support plate 116 and a hook 120 bent downward from an end of the extension 119.

The main body 121 is formed with a cooking chamber 122 and a component chamber 127, and has a rear plate 133 formed with the through holes 135. The outer casing (not shown) encloses the main body 121 and defines an outer appearance of the microwave oven.

An apparatus for suspending the microwave oven is constructed as follows. As shown in FIG. 6, the suspending apparatus comprises the engagement parts (not shown) provided on the bottom of the main body 121 so as to be engaged with the projections of the support plate 116, a reinforcement member 148 installed adjacent to the through hole 135 formed in the rear plate 133 of the main body 121, a movable member 151 coupled to a planar surface of the reinforcement member 148, and an actuating member 153 moving the movable member 151.

The reinforcement member 148 comprises a flat part 149 installed on the rear plate 133, and having an opening communicating with the through hole 135 of the rear plate 133, and a bent part 150 bent transversely relative to the flat part 149. The movable member 151 is hinge-coupled to the plane of the bent part 150 of the reinforcement member 148 by means of a hinge part 157 formed at one end thereof, and is coupled to a fixing point 154 of the reinforcement member 148 spaced from the hinge part 157 via a coil spring 155 at the other end thereof. The movable member 151 also has an engagement part 158 for engagement with the hook 120 of the hooking member 118. The movable member 151 is connected to the actuating member 153 which has the shape of a long rod; and the actuating member 153 is disposed between the main body 121 and the outer casing.

Hereinbelow, the process of provisionally installing the microwave oven to the support plate 116 will be described.

The support plate 116 is firstly fixed to a wall face to which the microwave oven is mounted. The microwave oven is lifted up so that the engagement parts formed in the lower part of the main body 121 are engaged with the projections of the support plate 116. After the engagement parts of the microwave oven are engaged with the projections of the support plate 116, the microwave oven can be rotated vertically relative to the engagement parts and the projections.

A grill member (not shown) is disengaged from the microwave oven, and the actuating member 153 is pulled forward while pushing the microwave oven toward the support plate 115. When the actuating member 153 is pulled forward, the coil spring 155 is extended and the movable member 151 rotates by a predetermined degree. If the microwave oven is pressed to the planar surface of the support plate 116 and then the actuating member 153 is released, the coil spring 155 is retracted and the movable member 151 is rotated reversely, so that the engagement part 158 of the movable member 151 is engaged with the hook 120 of the hooking member 118.

After the microwave oven is provisionally installed to the support plate 116 fixed to the wall face, the suspension of the microwave oven is finished by screw-coupling the outer casing to the upper cabinet.

However, the suspending apparatus for the conventional microwave oven has a complicated structure for provisionally installing the microwave oven to the support plate as shown in FIG. 6, thereby making it difficult to install the microwave oven and further increasing the cost of production.

Further, the length of the extension 119 of the hooking member 118 is short, making narrow a moving space of the engagement part 158 of the movable member 151. In order to solve this problem, the extension 119 of the hooking member 118 may be increased in length; however, in this case, the coupling force of the engagement part of the movable member 151 and the extension of the hooking member 118 becomes feeble. Therefore, when suspending the microwave oven from the shelf plate, the microwave oven may become disengaged from the support plate.

SUMMARY OF THE INVENTION

Accordingly, the present invention has been made keeping in mind the above problem, and an object of the present invention is to provide an apparatus for suspending a microwave oven, allowing the microwave oven to be installed to a support plate with a simplified structure and further reducing the cost of production.

Another object of the present invention is to provide an apparatus for suspending a microwave oven, with a high coupling force relative to a support plate.

These and other objects of the present invention may be accomplished by provision of an apparatus for suspending a microwave oven which includes a main body having a rear plate formed with a through hole thereon and a cooking chamber formed therein, the apparatus comprising: a support plate mounted to a wall face to which the microwave oven is installed; a hooking member protruding toward the main body through the through hole of the rear plate from a planar surface of the support plate; a plate spring having one end portion fixed to the main body and the other end portion elastically deformable between a first position where the plate spring is disengaged from the hooking member and a second position where the plate spring is engaged with the hooking member; and an actuating member connected between the microwave oven and the plate spring for elastically deforming the plate spring between the first position and the second position.

An elongated hole is formed on the plate spring, and the hooking member is inserted into the elongated hole.

The actuating member is comprised of a shaft taking a long rod shape, crossing the microwave oven, and a bent part bent from an end of the shaft.

The bent part is engaged with a front portion of the main body.

The support plate includes at least one projection protruding from its lower end, supporting the lower part of the microwave oven.

The apparatus further comprises at least one engagement part provided on the bottom of the main body, being engaged with the projection of the support plate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
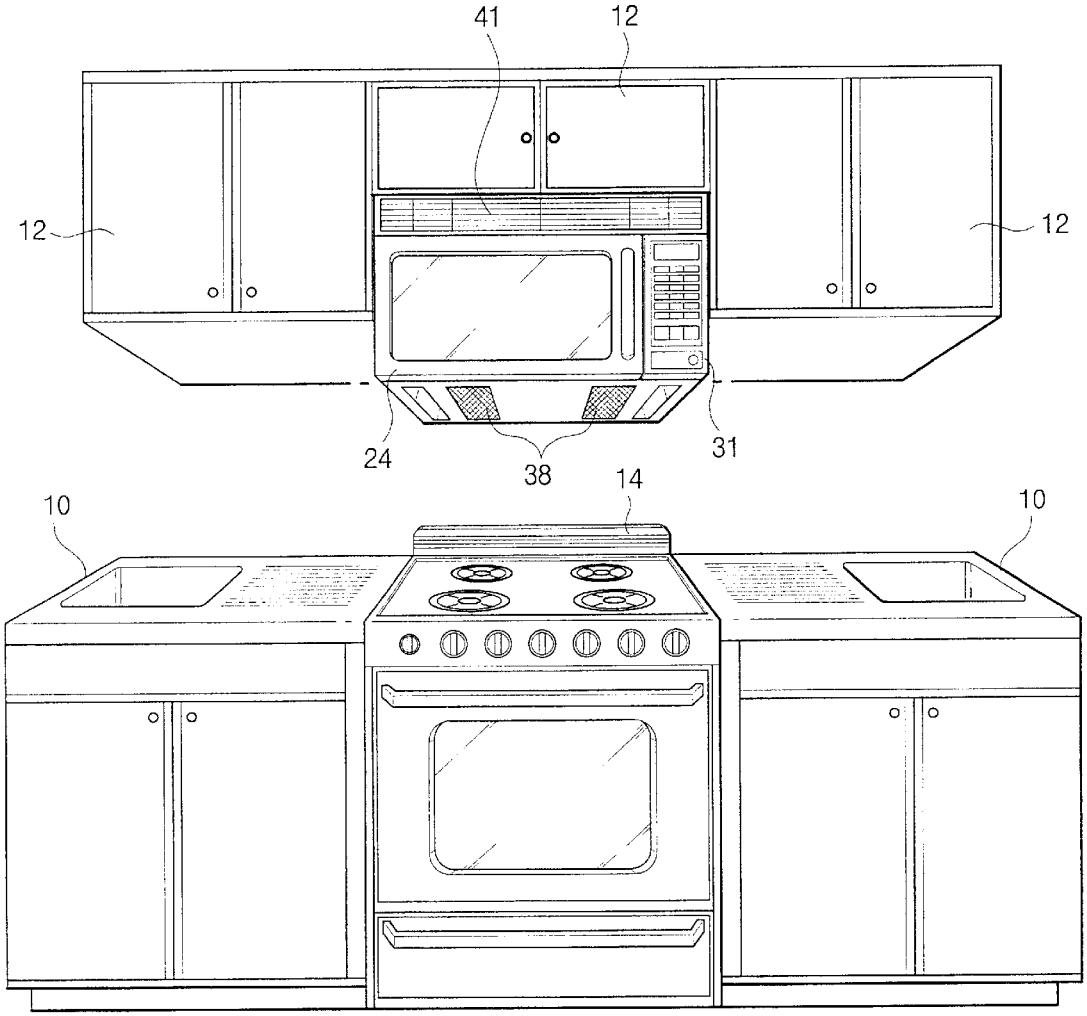
FIG. 1 is a view showing an installation state of a wall-mounted microwave oven according to the present invention.

As shown in FIG. 1, a kitchen is usually equipped with a gas range 14 for cooking food and a sink unit 10. Over the sink unit 10 are disposed a plurality of cabinets 12, formed with a space for accommodating glassware, kitchenware, etc. therein. Over the gas range 14 is mounted a wall-mounted microwave oven having an exhaust port through which fumes and vapor generated from the gas range 14 during cooking are exhausted.

The wall-mounted microwave oven is provisionally installed to a support plate 16 (FIG. 2) fixed to a wall face to which the microwave oven is installed before it is coupled to the bottom of the cabinet 12 in a suspension structure.

Figure 2:
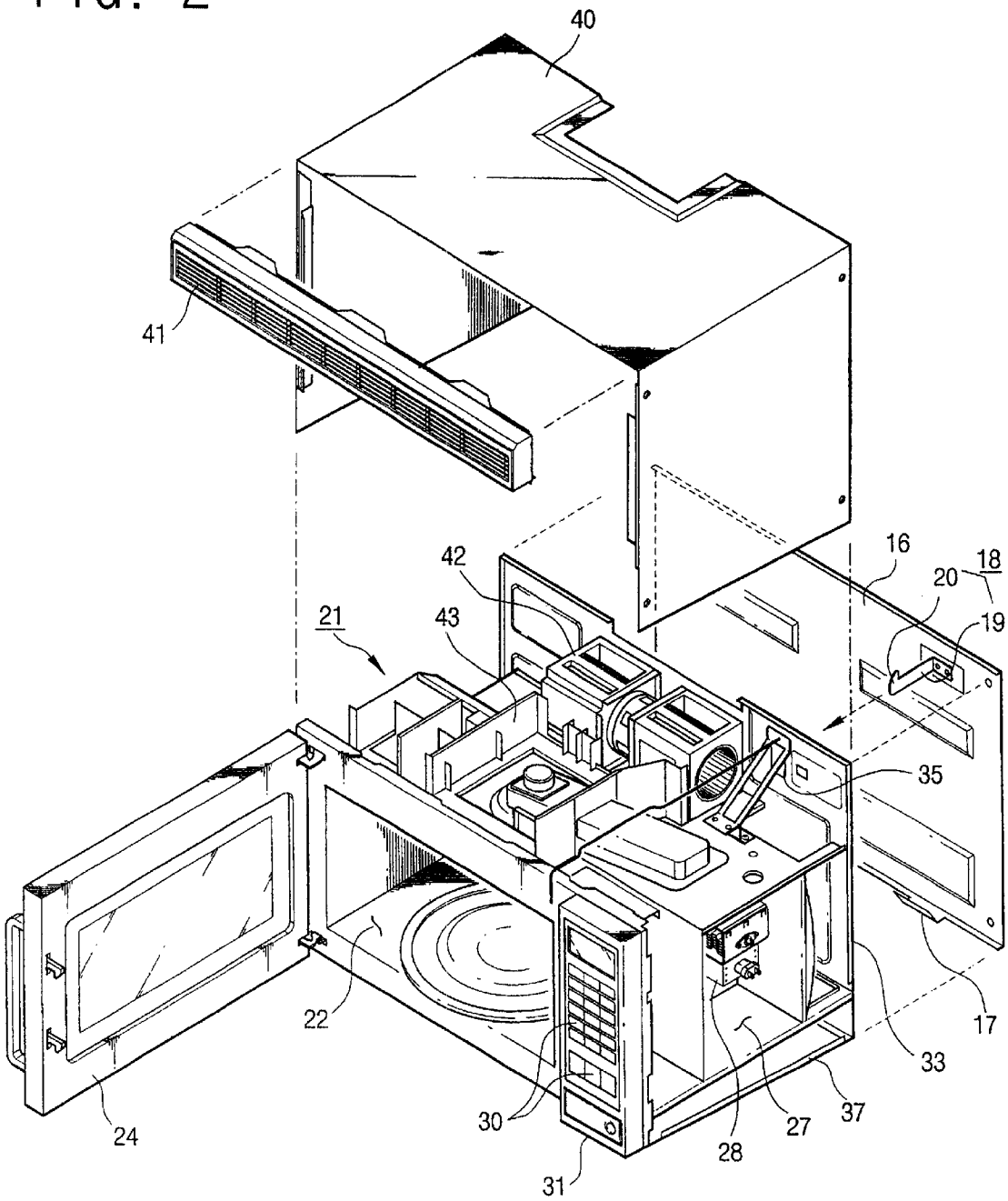
FIG. 2 is an exploded perspective view of the microwave oven and a support plate, according to the present invention.

As depicted in FIG. 2, on a lower end portion of the support plate 16 fixed to the wall face are provided a pair of projections 17. On an upper portion of the support plate 16 is provided a hooking member 18 passing through a through hole 35 of a rear plate 33 of a main body 21.

The hooking member 18 protrudes transversely from the planar surface of the support plate 16 and is disposed between the top of the main body 21 and an outer casing 40 after passing through the through hole 35 of the rear plate 33 of the main body 21. The hooking member 18 is comprised of an extension 19 protruding from the planar surface of the support plate 16 and a hook 20 bent upward from an end of the extension 19.

The main body 21 is formed with a cooking chamber 22 and a component chamber 27; and the outer casing 40 has an inverse "U" shape, surrounding the main body 21, to thereby define an external appearance of the microwave oven. The microwave oven further includes a door 24 for opening and closing the cooking chamber 22. Within the component chamber 27 are housed a plurality of components (not shown) including a magnetron 28. In front of the component chamber 27 is mounted a control panel 31 having a plurality of buttons 30 for selecting a cooking operation.

Between the main body 21 and the outer casing 40 is formed an air path for the flow of air. A grill member 41 for expelling vapor and smell generated from food during cooking is installed horizontally relative to the main body 21 in front of the air path. In the air path are provided a suction motor 42 for drawing outdoor air between the main body 21 and the outer casing 40 and a guide duct 43 for guiding the drawn air to the grill member 41. On a bottom plate 37 of the main body 21 are formed a plurality of inlet ports 38 (FIG. 1) for drawing in the vapor and fumes generated during cooking on gas range 14.

When the motor 42 starts to operate, the fumes and vapor are drawn in through the inlet ports 38 of the bottom plate 37 by means of a suction force of the motor 42, and are then guided by each guide duct 43 so as to be discharged through the grill member 41.

Figure 3:
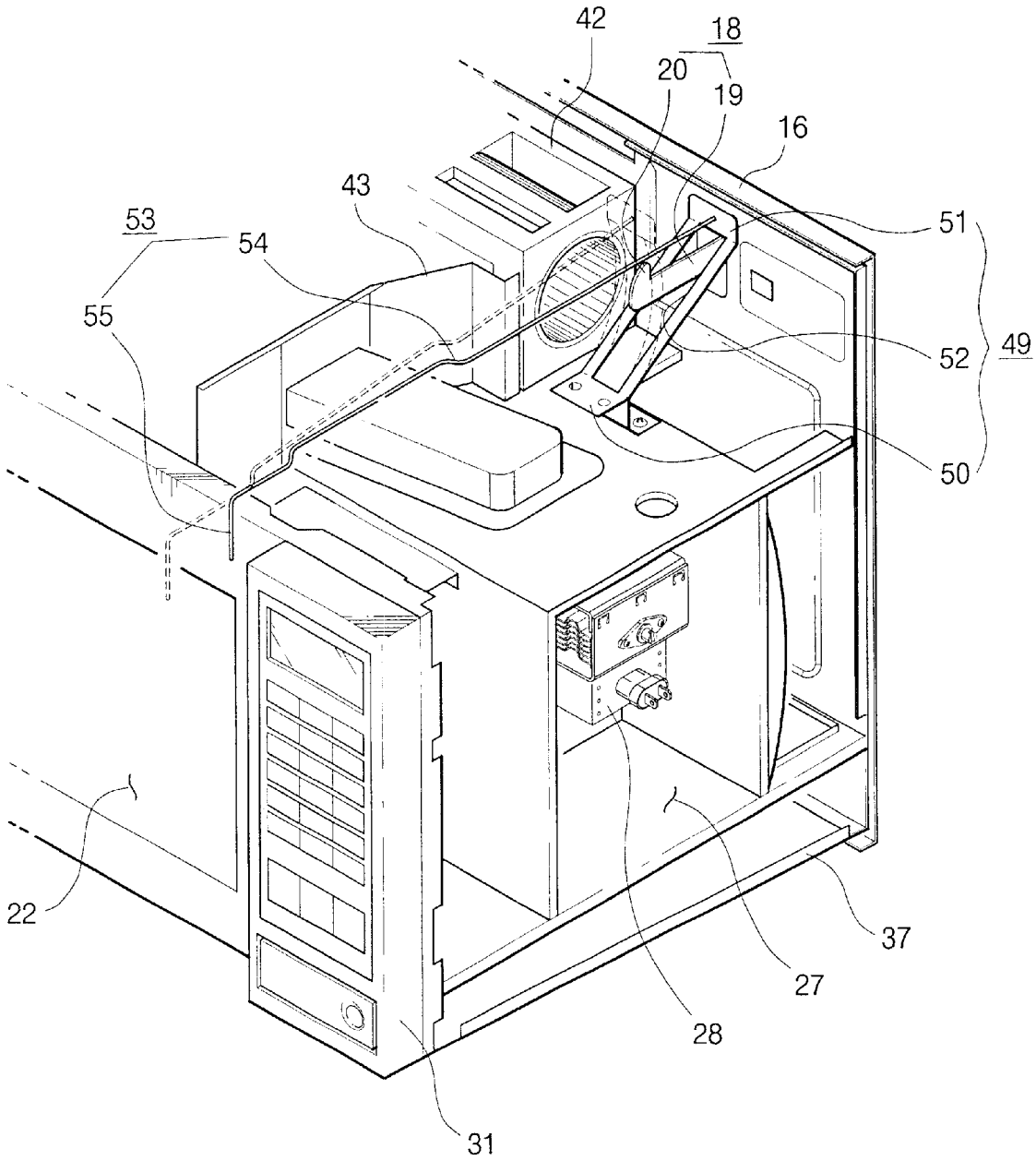
FIG. 3 is an enlarged perspective view showing a coupling state of the microwave oven and the support plate in FIG. 2.

Hereinafter, a suspending apparatus for a microwave oven according to the present invention will be described with reference to FIGS. 3 and 4. The suspending apparatus comprises a pair of engagement parts 47 which are formed in a rear edge portion of the bottom plate 37, and which are engaged with the projections 17 of the support plate 16, a plate spring 49 elastically deformable in response to rotation of the microwave oven, and an actuating member 53 for actuating the plate spring 49.

One end portion or a lower end portion 50 of the plate spring 49 is fixed to the main body 21, and the other or upper end portion 51 of the plate spring 49 can be elastically deformed between a first position and a second position. The first position is a position where the other or upper end portion 51. of the plate spring 49 is released from the hooking member 18; and the second position is a position where the other or upper end portion 51 of the plate spring 49 is engaged with the hooking member 18. On the planar surface of the plate spring 49 is formed an elongated hole 52, into which the hooking member 18 is inserted.

The actuating member 53 is comprised of a shaft 54 having a long rod shape and crossing the microwave oven between the main body 21 and the outer casing 40, and a bent part 55 bent from an end of the shaft 54. The bent part 55 is disposed adjacent to the grill member 41 and is engaged with a front portion of the main body 21. The actuating member 53 is connected to the other or upper end portion 51 of the plate spring 49 at the rear end portion thereof, pressing the plate spring 49 so as to maintain and release the elastic deformation of the plate spring 49.

The process of provisionally installing the wall-mounted microwave oven to the support plate 16 will be described.

The microwave oven is lifted up so that the pair of engagement parts 47 formed on the bottom plate 37 of the main body 21 are engaged with the projections 17 of the support plate 16. In the state where the engagement parts 47 of the main body 21 are engaged with the projections 17 of the support plate 16, the microwave oven is allowed to be rotated vertically relative to the engagement parts 47 and the projections 17 coupled to each other.

After the grill member 41 is removed from the microwave oven, the microwave oven is pushed toward the support plate 16 while pulling forward the bent part 55 of the actuating member 53. As the actuating member 53 is pulled forward, the other or upper end portion 51 of the plate spring 49 is curved forward with the lower end portion 50 of the plate spring 49 being fixed to the main body 21 (as indicated with dotted lines in FIG. 3).

After the microwave oven is pressed to the planar surface of the support plate 16, the actuating member 53 is released slowly, and the plate spring 49 is restored to its original state by its restoring force while the hooking member 18 is inserted into the elongated hole 52 of the plate spring 49.

After the microwave oven is provisionally installed to the support plate 16 mounted to the wall face, the outer casing 40 is screw-coupled to the cabinet 12 by means of a screw, thereby finishing the process of installing the microwave oven in suspension structure.

As described above, the present invention allows the hooking member 18 of the support plate 16 to be engaged with the microwave oven by means of the plate spring 49 having the elongated hole 52, thus providing a more simplified structure and facilitating the assembly.

Figure 4:
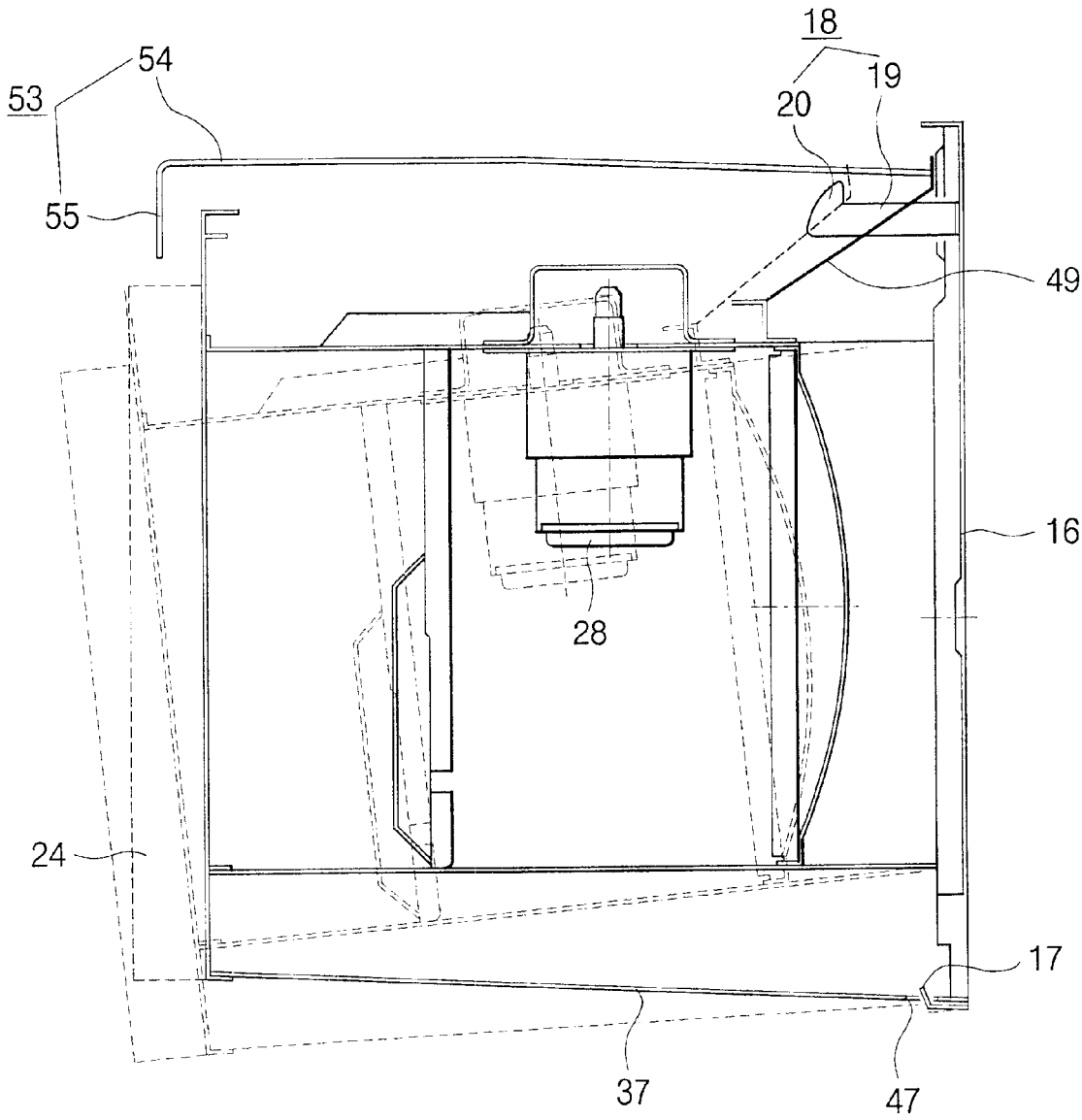
FIG. 4 is a sectional view showing the process of coupling the microwave oven to the support plate according to the present invention.
Figure 5:
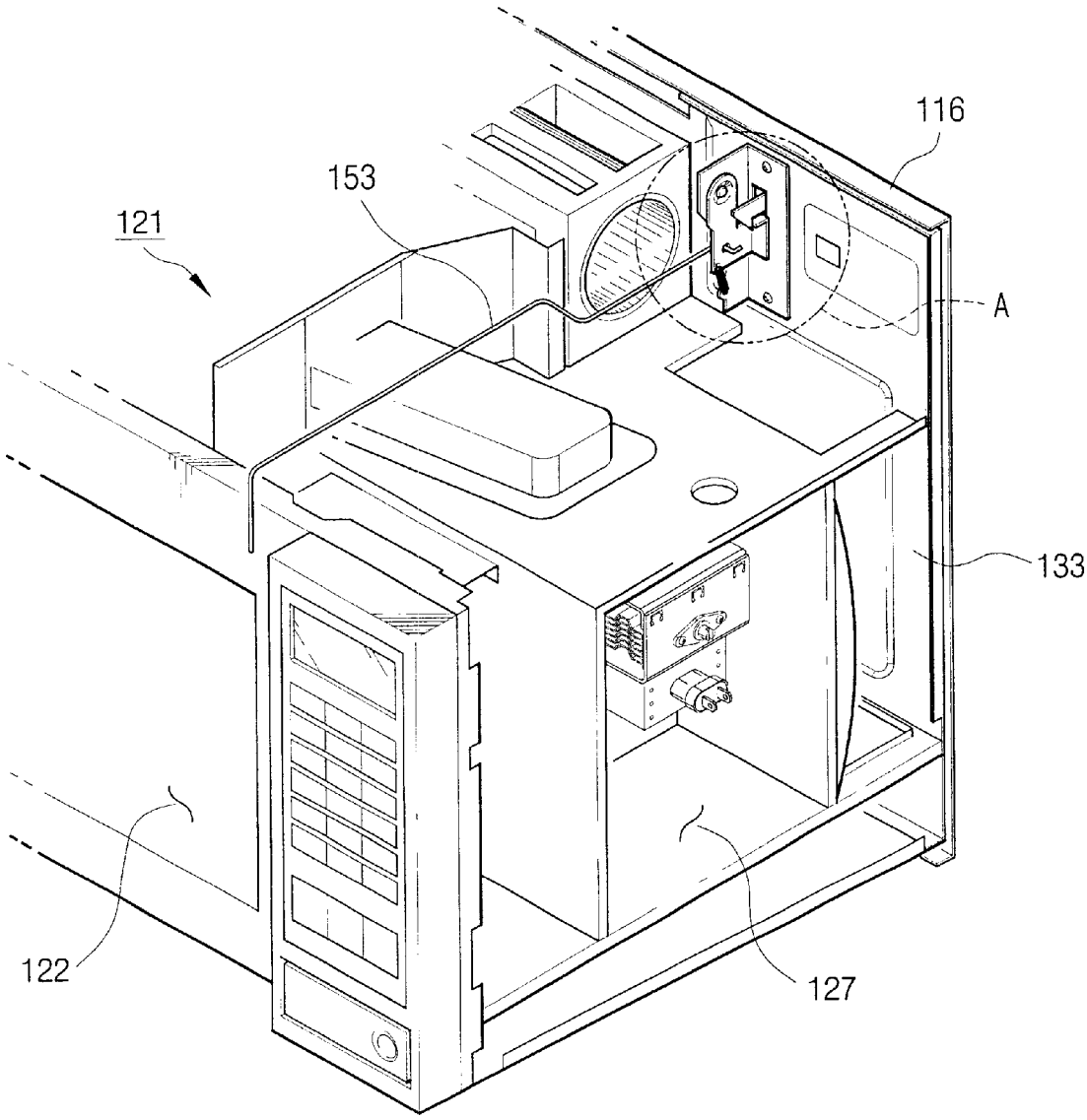
FIG. 5 (PRIOR ART)
FIG. 5 is an enlarged perspective view showing a main portion of a conventional microwave oven.
Figure 6:
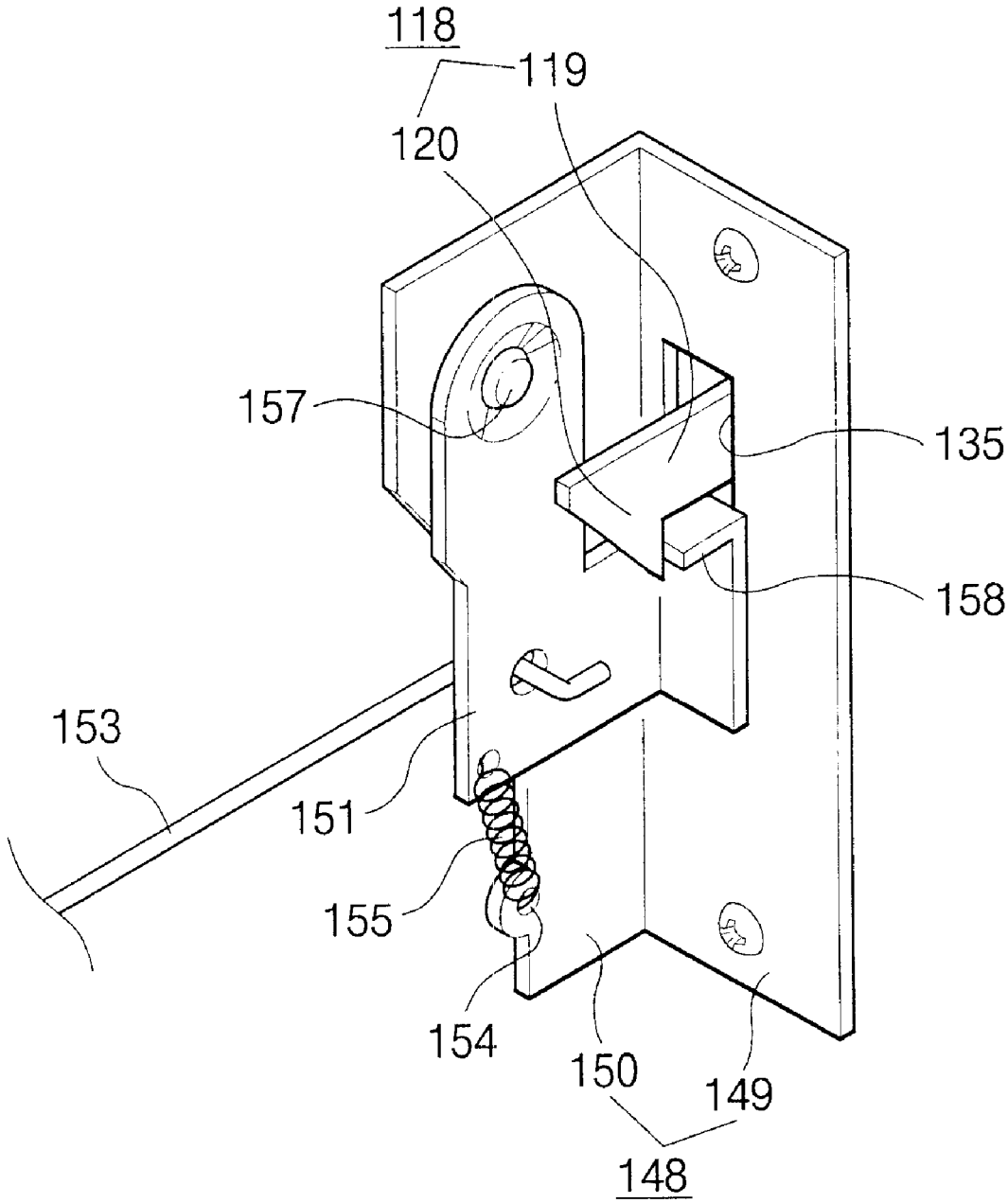
FIG. 6 (PRIOR ART)
FIG. 6 is an enlarged view showing a circle "A" of FIG. 5.

In this structure, while the coupling force of the plate spring 49 and the hooking member 18 is maintained constantly, the length of the extension 19 of the hooking member 18 can be increased lengthwise, thereby providing sufficient moving space for the plate spring 49 and the microwave oven (as indicated by dotted lines in FIG. 4).

Under the condition that the microwave oven is provisionally installed, the microwave oven can be rotated within a relatively large range of rotation, thereby making it easy to assemble the microwave oven with the cabinet in suspension structure.

In contrast to the above-described embodiment, the hooking member 18 can be engaged with the plate spring 49 without forming an elongated hole 52 in the plate spring 49.

According to the present invention, there is provided an apparatus for suspending a microwave oven, allowing the microwave oven to be provisionally installed to a support plate with a simplified structure, thereby reducing the cost of production and with a high coupling force.

Although a preferred embodiment of the present invention has been disclosed for illustrative purposes, those skilled in the art will appreciate that various modifications, additions and substitutions are possible without departing from the scope and spirit of the invention as disclosed in the accompanying claims.

What is claimed is:

1. An apparatus for suspending a microwave oven which includes a main body having a rear plate with a through hole formed thereon and a cooking chamber formed in said microwave oven, said apparatus comprising:

a support plate mounted to a wall face to which the microwave oven is installed;

a hooking member protruding from the support plate toward the main body through the through hole of the rear plate;

a plate spring mounted in said microwave oven and having one end portion fixed to the main body and another end portion elastically deformable between a first position where the plate spring is disengaged from the hooking member and a second position where the plate spring is engaged with the hooking member; and an actuating member mounted in said microwave oven and connected between the microwave oven and the plate spring for elastically deforming the plate spring between the first position and the second position.

2. The apparatus according to claim 1, wherein an elongated hole is formed on the plate spring, and the hooking member is inserted into the elongated hole.

3. The apparatus according to claim 1, the actuating member comprising a shaft having a long rod shape crossing the microwave oven, and a bent part located at an end of the shaft.

4. The apparatus according to claim 3, wherein the bent part is engaged with a front portion of the main body.

5. The apparatus according to claim 3, wherein the bent part is located at the end of the shaft remote from the plate spring.

6. The apparatus according to claim 1, wherein the support plate has a lower end and includes at least one projection protruding from the lower end for supporting a lower part of the microwave oven.

7. The apparatus according to claim 6, further comprising at least one engagement part provided on a bottom of the main body for engaging with said at least one projection of the support plate.

8. The apparatus according to claim 1, wherein the hooking member comprises an extension connected to the support plate and a hook located at an end of the extension remote from the support plate.

9. In a microwave oven which includes a main body having a rear plate with a through hole formed thereon and a cooking chamber formed in said microwave oven;

an apparatus for supporting the microwave oven, comprising:

a support plate mounted to a wall face to which the microwave oven is installed;

a hooking member protruding from the support plate toward the main body through the through hole of the rear plate;

a plate spring mounted in the microwave oven and having one end portion fixed to the main body and another end portion elastically deformable between a first position where the plate spring is disengaged from the hooking member and a second position where the plate spring is engaged with the hooking member; and an actuating member mounted in the microwave oven and connected between the microwave oven and the plate spring for elastically deforming the plate spring between the first position and the second position.

10. The apparatus according to claim 9, wherein an elongated hole is formed on the plate spring, and the hooking member is inserted into the elongated hole.

11. The apparatus according to claim 9, the actuating member comprises a shaft having a long rod shape crossing the microwave oven, and a bent part located at an end of the shaft.

12. The apparatus according to claim 11, wherein the bent part is engaged with a front portion of the main body.

13. The apparatus according to claim 11, wherein the bent part is located at the end of the shaft remote from the plate spring.

14. The apparatus according to claim 9, wherein the support plate has a lower end and includes at least one projection protruding from the lower end for supporting a lower part of the microwave oven.

15. The apparatus according to claim 14, further comprising at least one engagement part provided on a bottom of the main body for engaging with said at least one projection of the support plate.

16. The apparatus according to claim 9, wherein the hooking member comprises an extension connected to the support plate and a hook located at an end of the extension remote from the support plate.

17. The combination of a microwave oven, and an apparatus for supporting the microwave oven;

said microwave oven comprising a main body having a rear plate with a through hole formed thereon and a cooking chamber formed in said microwave oven; apparatus for supporting the microwave oven;

said apparatus comprising:

a support plate mounted to a wall face to which the microwave oven is installed;

a hooking member protruding from the support plate toward the main body through the through hole of the rear plate;

a plate spring mounted in said microwave oven and having one end portion fixed to the main body and another end portion elastically deformable between a first position where the plate spring is disengaged from the hooking member and a second position where the plate spring is engaged with the hooking member; and an actuating member mounted in said microwave oven and connected between the microwave oven and the plate spring for elastically deforming the plate spring between the first position and the second position.

18. The apparatus according to claim 17, wherein an elongated hole is formed on the plate spring, and the hooking member is inserted into the elongated hole.

19. The apparatus according to claim 17, the actuating member comprises a shaft having a long rod shape crossing the microwave oven, and a bent part located at an end of the shaft.

20. The apparatus according to claim 19, wherein the bent part is engaged with a front portion of the main body.

21. The apparatus according to claim 19, wherein the bent part is located at the end of the shaft remote from the plate spring.

22. The apparatus according to claim 17, wherein the support plate has a lower end and includes at least one projection protruding from the lower end for supporting a lower part of the microwave oven.

23. The apparatus according to claim 22, further comprising at least one engagement part provided on a bottom of the main body for engaging with said at least one projection of the support plate.

24. The apparatus according to claim 17, wherein the hooking member comprises an extension connected to the support plate and a hook located at an end of the extension remote from the support plate.

* * * * *